US008262808B2

(12) United States Patent
Nagata et al.

(10) Patent No.: US 8,262,808 B2
(45) Date of Patent: Sep. 11, 2012

(54) PERMANENT MAGNET AND METHOD OF MANUFACTURING SAME

(75) Inventors: Hiroshi Nagata, Ibaraki (JP); Kyuzo Nakamura, Kanagawa (JP); Takeo Katou, Kanagawa (JP); Atsushi Nakatsuka, Kanagawa (JP); Ichirou Mukae, Kanagawa (JP); Masami Itou, Kanagawa (JP); Ryou Yoshiizumi, Kanagawa (JP); Yoshinori Shingaki, Ibaraki (JP)

(73) Assignee: ULVAC, Inc., Kanagawa (JP)

( * ) Notice: Subject to any disclaimer, the term of this patent is extended or adjusted under 35 U.S.C. 154(b) by 354 days.

(21) Appl. No.: 12/519,878

(22) PCT Filed: Dec. 19, 2007

(86) PCT No.: PCT/JP2007/074405

§ 371 (c)(1),
(2), (4) Date: Jul. 30, 2009

(87) PCT Pub. No.: WO2008/075710

PCT Pub. Date: Jun. 26, 2008

(65) Prior Publication Data

US 2010/0026432 A1 Feb. 4, 2010

(30) Foreign Application Priority Data

Dec. 21, 2006 (JP) ..... 2006-344780

(51) Int. Cl.
*H01F 1/057* (2006.01)

(52) U.S. Cl. ..... 148/122; 148/101; 148/302

(58) Field of Classification Search ..... None
See application file for complete search history.

(56) References Cited

U.S. PATENT DOCUMENTS 6,468,365 B1 * 10/2002 Uchida et al. ..... 148/302
(Continued)

FOREIGN PATENT DOCUMENTS

CN 1806299 A 7/2006
(Continued)

OTHER PUBLICATIONS

Office Action from Chinese Patent App. No. 200780047801.1 (Apr. 22, 2011).

(Continued)

*Primary Examiner* — John Sheehan
(74) *Attorney, Agent, or Firm* — Cermak Nakajima LLP; Tomoko Nakajima

(57) ABSTRACT

There is provided a method of manufacturing a permanent magnet which has an extremely high coercive force and high magnetic properties is manufactured at high productivity. There are executed: a first step of causing at least one of Dy and Tb to adhere to at least part of a surface of iron-boron-rare-earth based sintered magnet; and a second step of diffusing, through heat-treatment at a predetermined temperature, at least one of Dy and Tb adhered to the surface of the sintered magnet into grain boundary phase of the sintered magnet. As the sintered magnet, there is used one which is manufactured by: mixing each powder of principal phase alloy (constituted primarily by $R_2T_{14}B$ phase, where R is at least one rare earth element primarily including Nd and where T is a transition metal primarily including Fe), and a liquid phase alloy (having a higher content of R than $R_2T_{14}B$ phase and primarily constituted by R-rich phase) in a predetermined mixing ratio; press-forming in magnetic field a mixed powder thus obtained; and sintering a press-formed body in vacuum or inert gas atmosphere.

10 Claims, 4 Drawing Sheets

U.S. PATENT DOCUMENTS

| | | | | |
|---|---|---|---|---|
| 2004/0189426 | A1* | 9/2004 | Hidaka et al. | 335/202 |
| 2006/0213583 | A1 | 9/2006 | Nakamura et al. | |
| 2006/0278517 | A1* | 12/2006 | Machida et al. | 204/192.1 |
| 2007/0017601 | A1* | 1/2007 | Miyata et al. | 148/105 |
| 2007/0034299 | A1 | 2/2007 | Machida et al. | |
| 2007/0240787 | A1* | 10/2007 | Nakamura et al. | 148/101 |
| 2007/0240788 | A1* | 10/2007 | Nakamura et al. | 148/101 |
| 2008/0247898 | A1* | 10/2008 | Nakamura et al. | 419/9 |
| 2009/0322459 | A1* | 12/2009 | Nagata et al. | 335/302 |
| 2010/0164663 | A1* | 7/2010 | Nagata et al. | 335/302 |

FOREIGN PATENT DOCUMENTS

| | | | |
|---|---|---|---|
| EP | 1 643 513 | A1 * | 4/2006 |
| JP | 03-277733 | A | 12/1991 |
| JP | 2005-175138 | | 6/2005 |
| JP | 2006-303433 | | 11/2006 |
| WO | WO2006-100968 | | 9/2006 |

OTHER PUBLICATIONS

Kite, P., "Improvement of coercivity on thin Nd2Fe14B sintered permanent magnets," Mar. 23, 2000, Tohoku University, Doctor Thesis.

International Search Report for PCT Patent App. No. PCT/JP2007/074405 (Mar. 18, 2008).

* cited by examiner

FIG.5

Dy Vapor Processing

| | | Vapor Processing Time(h) | Br(kG) | iHc(k0e) | (BH) max(MG0e) | (BH) max+iHc |
|---|---|---|---|---|---|---|
| Compar -ative Example 1a | One Alloy Method | 0 | 13.9 | 14.6 | 47.2 | 61.8 |
| | | 2 | 13.9 | 17.1 | 47.2 | 64.3 |
| | | 6 | 13.8 | 19.3 | 46.6 | 65.9 |
| | | 12 | 13.8 | 23.1 | 46.5 | 69.6 |
| This Invention | Two Alloy Method | 0 | 14.1 | 14.7 | 48.6 | 63.3 |
| | | 2 | 14.1 | 20.3 | 48.6 | 68.9 |
| | | 6 | 14.1 | 25.3 | 48.7 | 74.0 |
| | | 12 | 14.0 | 25.5 | 48.2 | 73.7 |

FIG.6

Tb Vapor Processing

| | | Vapor Processing Time(h) | Br(kG) | iHc(k0e) | (BH) max(MG0e) | (BH) max+iHc |
|---|---|---|---|---|---|---|
| Compar -ative Example 1a | One Alloy Method | 0 | 13.9 | 14.6 | 47.2 | 61.8 |
| | | 2 | 13.9 | 18.3 | 47.1 | 65.4 |
| | | 4 | 13.8 | 21.3 | 47.0 | 68.3 |
| | | 8 | 13.8 | 25.8 | 47.0 | 72.8 |
| This Invention | Two Alloy Method | 0 | 14.1 | 14.7 | 48.6 | 63.3 |
| | | 2 | 14.2 | 25.6 | 48.7 | 74.3 |
| | | 4 | 14.2 | 28.1 | 48.7 | 76.8 |
| | | 8 | 14.0 | 28.0 | 48.6 | 76.6 |

PERMANENT MAGNET AND METHOD OF MANUFACTURING SAME

This application is a national phase entry under 35 U.S.C. §371 of PCT Patent Application No. PCT/JP2007/74405, filed on Dec. 19, 2007, which claims priority under 35 U.S.C. §119 to Japanese Patent Application No. 2006-344780, filed Dec. 21, 2006, both of which are incorporated by reference.

TECHNICAL FIELD

The present invention relates to a permanent magnet and a method of manufacturing the permanent magnet, and more particularly relates to a permanent magnet having high magnetic properties in which Dy and/or Tb is diffused into grain boundary phase of a Nd—Fe—B based sintered magnet, and to a method of manufacturing the permanent magnet.

BACKGROUND ART

A Nd—Fe—B based sintered magnet (so-called neodymium magnet) is made of a combination of iron and elements of Nd and B that are inexpensive, abundant, and stably obtainable natural resources and can thus be manufactured at a low cost and additionally has high magnetic properties (its maximum energy product is about 10 times that of ferritic magnet). Accordingly the Nd—Fe—B based sintered magnets have been used in various kinds of articles such as electronic devices and have recently come to be adopted in motors and electric generators for hybrid cars.

On the other hand, since the Curie temperature of the above-described sintered magnet is as low as about 300° C., there is a problem in that the Nd—Fe—B sintered magnet sometimes rises in temperature beyond a predetermined temperature depending on the circumstances of service of the product to be employed and therefore that it will be demagnetized by heat when heated beyond the predetermined temperature. In using the above-described sintered magnet in a desired product, there are cases where the sintered magnet must be fabricated into a predetermined shape. There is then another problem in that this fabrication gives rise to defects (cracks and the like) and strains to the grains of the sintered magnet, resulting in a remarkable deterioration in the magnetic properties.

Therefore, when the Nd—Fe—B sintered magnet is obtained, it is considered to add Dy and Tb which largely improve the grain magnetic anisotropy of principal phase because they have magnetic anisotropy of 4f-electron larger than that of Nd and because they have a negative Stevens factor similar to Nd. However, since Dy and Tb take a ferrimagnetism structure having a spin orientation negative to that of Nd in the crystal lattice of the principal phase, the strength of magnetic field, accordingly the maximum energy product exhibiting the magnetic properties is extremely reduced.

In order to solve this kind of problem, it has been proposed: to form a film of Dy and Tb to a predetermined thickness (to be formed in a film thickness of above 3 μm depending on the volume of the magnet) over the entire surface of the Nd—Fe—B sintered magnet; then to execute heat treatment at a predetermined temperature; and to thereby homogeneously diffuse the Dy and Tb that have been deposited (formed into thin film) on the surface into the grain boundary phase of the magnet (see non-patent document 1).

The permanent magnet manufactured in the above-described method has an advantage in that: because Dy and Tb diffused into the grain boundary phase improve the grain magnetic anisotropy of each of the grain surfaces, the nucleation type of coercive force generation mechanism is strengthened; as a result, the coercive force is dramatically improved; and the maximum energy product will hardly be lost (it is reported in non-patent document 1 that a magnet can be obtained having a performance, e.g., of the remanent flux density: 14.5 kG (1.45 T), maximum energy product: 50 MGOe (400 kJ/m$^3$), and coercive force: 23 kOe (3 MA/m)).

[Non-patent document 1] Improvement of coercivity on thin $Nd_2Fe_{14}B$ sintered permanent magnets (by Pak Kite of Tohoku University Doctor Thesis, Mar. 23, 2000)

DISCLOSURE OF THE INVENTION

Problems to be Solved by the Invention

For example, if the coercive force is further increased, even if the thickness of the permanent magnet is made smaller, there can be obtained a permanent magnet having a stronger magnetic force. Therefore, in order to attain a reduction in size, reduction in weight, and low power, it is desired to develop a permanent magnet having a still higher coercive force and higher magnetic properties as compared with the above-described prior art. In addition, since there is used Dy and/or Tb that is scanty as natural resources and a stable supply of which cannot be expected, it is necessary to improve the productivity by efficiently executing the film formation of Dy and/or Tb on the surface of the sintered magnet and the diffusion of Dy and/or Tb into the grain boundary phase of the sintered magnet.

Therefore, in view of the above points, a first object of this invention is to provide a permanent magnet having an extremely high coercive force and high magnetic properties. A second object of this invention is to provide a method of manufacturing a permanent magnet having an extremely high coercive force and high magnetic properties at high workability

Means for Solving the Problems

In order to solve the above problems, a method of manufacturing a permanent magnet comprises: a first step of causing at least one of Dy and Tb to adhere to at least part of a surface of iron-boron-rare-earth based sintered magnet; and a second step of diffusing, through heat-treatment at a predetermined temperature, at least one of Dy and Tb adhered to the surface of the sintered magnet into grain boundary phase of the sintered magnet, wherein the sintered magnet is manufactured by: mixing each powder of principal phase alloy (constituted primarily by $R_2T_{14}B$ phase, where R is at least one rare earth element primarily including Nd and where T is a transition metal primarily including Fe), and a liquid phase alloy (having a higher content of R than $R_2T_{14}B$ phase and primarily constituted by R-rich phase) in a predetermined mixing ratio; press-forming in magnetic field a mixed powder thus obtained; and sintering a press-formed body in one of vacuum and inert gas atmosphere.

According to this invention, the sintered magnet manufactured by the so-called two alloy method in which the principal phase alloy and the liquid phase alloy are separately ground, and thereafter molded and sintered, are large in grain and round in shape (i.e., less nucleation site), good in orientation, and rare-earth (Nd)-rich phase present in grain boundary increased with good diffusion (i.e., the rare-earth-rich layer that is non-magnetic and increases the coercive force by magnetically insulating the principal phase is diffused while increasing in more than double as compared with the one manufactured in a so-called one alloy method). Therefore, by executing the above-described processing on this sintered magnet, the velocity of diffusion of the metal atoms of Dy and Tb into the rare-earth-rich phase of the grain boundary becomes faster, and the metal atoms can be efficiently diffused in a short time. In addition, since the concentration of Dy and Tb in the rare earth-rich phase, which is good in diffusion, can be effectively increased, there can be obtained a permanent magnet that has still higher coercive force and higher magnetic properties.

Preferably the sintered magnet is disposed in a processing chamber and heated; an evaporating material comprising at least one of Dy and Tb and disposed in one of a same and another processing chamber is heated and caused to be evaporated; this evaporated evaporating material is caused to be adhered, while adjusting an amount of supply to a surface of the sintered magnet; metal atoms of at least one of Dy and Tb of the adhered evaporating material are diffused into the grain boundary phase of the sintered magnet before a thin film made of the evaporating material is formed on the surface of the sintered magnet; and the first step and the second step are performed.

According to this configuration, the evaporated evaporating material (metal atoms or molecules of Dy and/or Tb) are caused to be adhered by being supplied to the surface of the sintered magnet that has been heated to a predetermined temperature. At that time, the sintered magnet is heated to a predetermined temperature to obtain an adequate diffusion velocity and also the amount of supply of the evaporating material to the surface of the sintered magnet is adjusted. Therefore, the evaporating material that has been adhered to the surface is sequentially diffused into the grain boundary phase of the sintered magnet before the thin film is formed (i.e., the supply to the surface of the sintered magnet, of Dy and/or Tb, and the like, and the diffusion into the grain boundary phase of the sintered magnet, of Dy and/or Tb, and the like, are performed in a single processing (vacuum vapor processing)). Therefore, the surface conditions of the permanent magnet are substantially the same as those before the above processing is performed. The surface of the manufactured permanent magnet can thus be prevented from getting deteriorated (surface roughness from becoming worse) and, in particular, the diffusion of Dy and/or Tb is restricted from being excessively diffused into the grain boundary near the surface of the sintered magnet. As a result, subsequent steps are not particularly required, thereby attaining a high productivity.

In this case, because the grain boundary phase has Dy-rich or Tb-rich phase (a phase having Dy and/or Tb in the range of 5~80%) and, further, because Dy and/or Tb is diffused only near the surfaces of the grains, there will be a permanent magnet of high magnetic properties. Further, in case there have occurred defects (cracks) in the grains near the surface of the sintered magnet at the time of working the sintered magnet, there is formed a Dy-rich or Tb-rich phase on the inside of the cracks, and the magnetization intensity and the coercive force can be recovered.

In the above processing, if the sintered magnet and the evaporating material are disposed at a distance from each other, when the evaporating material is evaporated, the melted evaporating material can advantageously be prevented from getting directly adhered to the sintered magnet.

If a specific surface area of the evaporating material to be disposed in the processing chamber is varied to increase or decrease the amount of evaporation at a constant temperature, the amount of supply of the evaporating material to the surface of the sintered magnet can advantageously be adjusted easily without the need of changing the configuration of the apparatus such as by providing the processing chamber with a separate part to increase or decrease the amount of supply of the evaporating material.

Preferably prior to the heating of the processing chamber that has disposed therein the sintered magnet, the processing chamber is reduced in pressure to a predetermined pressure and is kept to that pressure.

In this case, after having reduced the pressure in the processing chamber, the processing chamber is heated to a predetermined temperature and is kept at the temperature in order to accelerate the removal of the stains, gas, and moisture adsorbed on the surface of the sintered magnet.

On the other hand, prior to the heating of the processing chamber that has disposed therein the sintered magnet, preferably cleaning by plasma is executed of the surface of the sintered magnet in order to remove an oxide film on the surface of the sintered magnet.

After at least one of Dy and Tb has been diffused into the grain boundary phase of the sintered magnet, heat treatment is executed for removing strains of the permanent magnet at a temperature that is lower than the said temperature. Then, there can be obtained a permanent magnet of high magnetic properties in which the magnetization intensity and the coercive force are further improved.

In addition, after having diffused Dy and/or Tb into the grain boundary phase of the sintered magnet, the permanent magnet may be manufactured by cutting it into a predetermined thickness in a direction perpendicular to the direction of magnetic orientation. According to this configuration, as compared with the case in which the sintered magnet of a block form having predetermined dimensions is cut into a plurality of thin pieces, they are then housed by disposing in this state in the processing chamber, and they are then subjected to the above-described vacuum vapor processing, the taking the sintered magnets into, and out of, the processing chamber can be performed in a shorter time. The preparatory work of executing the vacuum vapor processing becomes simplified and the productivity can be improved.

In this case, if the sintered magnet is cut into a desired shape by means of a wire cutter, and the like, there are cases in which cracks are generated in the grains which are the principal phases on the surface of the sintered magnet, resulting in a remarkable deterioration of the magnetic properties. However, if the above-described vacuum vapor processing is performed, the grain boundary phase has Dy-rich phases and further since the Dy is diffused only near the surface of the grains. Therefore, even in case the permanent magnet is obtained by cutting the sintered magnet into a plurality of thin pieces in a subsequent step, the magnetic properties are prevented from getting deteriorated. In combination with the fact that the finishing work is not required, there can be obtained a permanent magnet that is superior in productivity.

Further, in order to solve the above-described problems, the permanent magnet is made by using a sintered magnet manufactured by: mixing each powder of principal phase alloy (constituted primarily by $R_2T_{14}B$ phase, where R is at least one rare earth element primarily including Nd and where T is a transition metal primarily including Fe), and a liquid phase alloy (having a higher content of R than $R_2T_{14}B$ phase and primarily constituted by R-rich phase) in a predetermined mixing ratio; press-forming in magnetic field a mixed powder thus obtained; and sintering a press-formed body in one of vacuum and inert gas atmosphere. The sintered magnet is disposed in a processing chamber and heated; an evaporating material comprising at least one of Dy and Tb and disposed in one of a same and another processing chamber is heated and caused to be evaporated; this evaporated evaporating material is caused to be adhered, while adjusting an amount of supply, to a surface of the sintered magnet; and metal atoms of Dy, Tb of the adhered evaporating material are diffused into the grain boundary phase of the sintered magnet before a thin film made of the evaporating material is formed on the surface of the sintered magnet.

Effects of the Invention

As explained hereinabove, the method of manufacturing a permanent magnet according to this invention has an effect in that the Dy, Tb adhered to the surface of the sintered magnet can be efficiently diffused into the grain boundary phase and therefore that there can be manufactured a permanent magnet having a high productivity and high magnetic properties. In addition, the permanent magnet according to this invention has an effect of having a higher coercive force and higher magnetic properties.

BEST MODE FOR CARRYING OUT THE INVENTION

Description will now be made with reference to FIGS. 1 and 2. The permanent magnet M of this invention is manufactured by simultaneously executing a series of processes (vacuum vapor processing) of: evaporating and causing to adhere an evaporating material V containing at least one of Dy and Tb to the surface of a Nd—Fe—B based sintered magnet that has been fabricated to a predetermined shape; and of subsequently causing the metal atoms of Dy and/or Tb of the evaporating material to be diffused to the grain boundary phase of the sintered magnet S for homogeneous penetration.

The Nd—Fe—B based sintered magnet S as the starting material is manufactured in the following manner by a so-called two alloy method. That is, there is obtained a mixture powder of a principal phase alloy (constituted primarily by $R_2T_{14}B$ phase, where R is at least one rare earth element primarily including Nd and where T is a transition metal primarily including Fe), and a liquid phase alloy (having a higher content of R than $R_2T_{14}B$ phase and primarily constituted by R-rich phase). In the embodiment, the principal phase alloy was obtained by formulating Fe, B, Nd in a predetermined composition ratio, thereby manufacturing an alloy raw material in a known SC fusion casting method, then this manufactured alloy raw material was coarsely crushed in Ar, e.g., to below 50 meshes. On the other hand, the liquid phase alloy was also obtained by formulating Nd, Dy Co, Fe in a predetermined composition ratio, thereby manufacturing an alloy raw material in a known SC fusion casting method, and then the manufactured alloy material was coarsely crushed in Ar, e.g., to below 50 meshes.

Then, the obtained powder of the principal phase and the powder of the liquid phase were mixed in a predetermined mixing ratio (e.g., principal phase:liquid phase=90 wt %:10 wt %) and were once coarsely crushed by hydrogen crushing process and, subsequently were finely ground in nitrogen atmosphere by jet mill fine grinding process, thereby obtaining a raw meal (or mixture) powder. Then, by a known compression forming machine the raw meal powder was oriented in a magnetic field and was compression-molded into a predetermined shape such as a parallelepiped or columnar shape in a metallic mold. Then, the compression-molded body was sintered under predetermined conditions to thereby obtain the sintered magnet. According to this configuration, there can be obtained a sintered magnet S that has large and round grains (i.e., less nucleation site), good orientation properties, good diffusion characteristics of rare-earth (Nd)-rich phase that is present in the crystal grains (i.e., the rare-earth-rich layer that is non-magnetic and enhances the coercive force by magnetically insulating the principal phase is diffused in a state of being increased by more than two times as compared with the one manufactured in a so-called one alloy method).

In compression-molding the alloy raw meal powder, in case the known lubricant is added to the alloy raw meal powder, it is preferable to optimize the conditions in each of the steps of manufacturing the sintered magnet S so that the mean grain diameter of the sintered magnet S falls within the range of 4 μm~12 μm. According to this configuration, without being influenced by the residual carbon in the sintered magnet S, Dy and/or Tb adhered to the surface of the sintered magnet can be efficiently diffused into the grain boundary phase. If the mean grain diameter is smaller than 4 μm, a permanent magnet having a high coercive force can be obtained due to the diffusion of Dy and/or Tb into the grain boundary phase. However, this will diminish the advantage of adding the lubricant to the alloy raw meal powder, the advantage being in that the flowability can be secured during compression molding in the magnetic field and the orientation can be improved. The orientation of the sintered magnet will become poor and, as a result, the remanent flux density and maximum energy product exhibiting the magnetic properties will be lowered. On the other hand, if the mean grain diameter is larger than 12 μm, the coercive force will be lowered because the crystal is large. In addition, since the surface area of the grain boundary becomes smaller, the ratio of concentration of the residual carbon near the grain boundary becomes large and the coercive force becomes largely lowered. Further, the residual carbon reacts with Dy and/or Tb, and the diffusion of Dy into the grain boundary phase is impeded and the time of diffusion becomes longer, resulting in poor productivity As shown in FIG. 2, a vacuum vapor processing apparatus 1 for executing the above-described processing has a vacuum chamber 12 in which a pressure can be reduced to, and kept at, a predetermined pressure (e.g., $1\times10^{-5}$ Pa) through an evacuating means 11 such as turbo-molecular pump, cryopump, diffusion pump, and the like. There is disposed in the vacuum chamber 12 a box body 2 comprising: a rectangular parallelopiped box part 21 with an upper surface being open; and a lid part 22 which is detachably mounted on the open upper surface of the box part 21.

A downwardly bent flange 22*a* is formed along the entire circumference of the lid part 22. When the lid part 22 is mounted in position on the upper surface of the box part 21, the flange 22*a* is fitted into the outer wall of the box part 21 (in this case, no vacuum seal such as a metal seal is provided), so as to define a processing chamber 20 which is isolated from the vacuum chamber 11. It is so configured that, when the vacuum chamber 12 is reduced in pressure through the evacuating means 11 to a predetermined pressure (e.g., $1\times10^{-5}$ Pa), the processing chamber 20 is reduced in pressure to a pressure (e.g., $5\times10^{-4}$ Pa) that is higher substantially by half a digit than that in the vacuum chamber 12.

The volume of the processing chamber 20 is set, taking into consideration the mean free path of the evaporating material V, such that the evaporating material V (molecules) in the vapor atmosphere can be supplied to the sintered magnet S directly or from a plurality of directions by repeating collisions. The surfaces of the box part 21 and the lid part 22 are set to have thicknesses not to be thermally deformed when heated by a heating means to be described hereinafter, and are made of a material that does not react with the evaporating material V.

In other words, when the evaporating material V is, e.g., Dy, Tb, in case $Al_2O_3$ which is often used in an ordinary vacuum apparatus is used, there is a possibility that Dy, Tb in the vapor atmosphere reacts with $Al_2O_3$ so as to form reaction products on the surface thereof. Accordingly the box body 2 is made, e.g., of Mo, W, V, Ta or alloys of them (including rare earth elements added Mo alloy Ti added Mo alloy and the like), CaO, $Y_2O_3$ or oxides of rare earth elements, or constituted by forming an inner lining on the surface of another insulating material. A bearing grid 21*a* of, e.g., a plurality of Mo wires (e.g., 0.1~10 mm (dia.)) is arranged in lattice at a predetermined height from the bottom surface in the processing chamber 20. On this bearing grid 21*a* a plurality of sintered magnets S can be placed side by side. On the other hand, the evaporating material V is an alloy containing Dy and Tb or at least one of Dy and Tb which largely improve the magnetocrystalline anisotropy of the principal phase, and is appropriately disposed on a bottom surface, side surfaces or a top surface of the processing chamber 20.

The vacuum chamber 12 is provided with a heating means 3. The heating means 3 is made of a material that does not react with Dy, Tb of the evaporating material V, in the same manner as is the box body 2, and is arranged, e.g., so as to enclose the circumference of the box body 2. The heating means 3 comprises: a thermal insulating material of Mo make which is provided with a reflecting surface on the inner surface thereof; and an electric heater which is disposed on the inside of the thermal insulating material and which has a filament of Mo make. By heating the box body 2 by the heating means 3 at a reduced pressure, the processing chamber 20 is indirectly heated through the box body 2, whereby the inside of the processing chamber 20 can be heated substantially uniformly.

A description will now be made of the manufacturing of a permanent magnet M using the above-described vacuum vapor processing apparatus 1. First of all, sintered magnets S made in accordance with the above-described method are placed on the bearing grid 21*a* of the box part 21, and Dy as the evaporating material V is placed on the bottom surface of the box part 21 (according to this, the sintered magnets S and the evaporating material V are disposed at a distance from each other in the processing chamber 20). After having mounted in position the lid part 22 on the open upper surface of the box part 21, the box body 2 is placed in a predetermined position enclosed by the heating means 3 in the vacuum chamber 12 (see FIG. 2). Then through the evacuating means 11 the vacuum chamber 12 is evacuated until it reaches a predetermined pressure (e.g., $1\times10^{-4}$ Pa) (the processing chamber 20 is evacuated to a pressure substantially half-digit higher than the above) and the processing chamber 20 is heated by actuating the heating means 3 when the vacuum chamber 12 has reached the predetermined pressure.

When the temperature in the processing chamber 20 has reached the predetermined temperature under reduced pressure, Dy placed on the bottom surface of the processing chamber 20 is heated to substantially the same temperature as the processing chamber 20, and starts evaporation, and accordingly a vapor atmosphere of Dy is formed inside the processing chamber 20. Since the sintered magnets S and Dy are disposed at a distance from each other, when Dy starts evaporation, melted Dy will not be directly adhered to the sintered magnet S whose surface Nd-rich phase is melted. Then, Dy atoms in the vapor atmosphere of Dy are supplied to the surface of the sintered magnet S that has been heated to substantially the same temperature as Dy from a plurality of directions either directly or by repeating collisions, and get adhered thereto. The adhered Dy will be diffused into the grain boundary phase of the sintered magnet S, whereby a permanent magnet M can be obtained.

As shown in FIG. 3, when the Dy atoms in the Dy vapor atmosphere are supplied to the surface of the sintered magnet S so as to form a Dy (thin film) layer L1, the surface of the permanent magnet M will be remarkably deteriorated (surface roughness becomes worsened) when Dy is recrystallized. In addition, Dy adhered to, and deposited on, the surface of the sintered magnet S that has been heated to substantially the same temperature during processing gets melted and Dy will excessively be diffused into the grains in a region R1 near the surface of the sintered magnet S. As a result, the magnetic properties cannot be effectively improved or recovered.

That is, once a thin film made of Dy is formed on the surface of the sintered magnet S, the average composition on the surface of the sintered magnet S adjoining the thin film becomes Dy-rich composition. Once the average composition becomes Dy-rich composition, the liquid phase temperature lowers and the surface of the sintered magnet S gets melted (i.e., the principal phase is melted and the amount of liquid phase increases). As a result, the region near the surface of the sintered magnet S is melted and collapsed and thus the asperities increase. In addition, Dy excessively penetrates into the grains together with a large amount of liquid phase and thus the maximum energy product and the remanent flux density exhibiting the magnetic properties are further lowered.

According to this embodiment, Dy in bulk form (substantially spherical shape) having a small surface area per unit volume (specific surface area) was disposed on the bottom surface of the processing chamber 20 in a ratio of 1~10% by weight of the sintered magnet so as to reduce the amount of evaporation at a constant temperature. In addition, when the evaporating material V is Dy the temperature in the processing chamber 20 was set to a range of 700° C.~1050° C., preferably 900° C.~1000° C., by controlling the heating means 3 (when the processing chamber is, e.g., 900° C.~1000° C., the saturated vapor pressure of Dy becomes about $1\times10^{-2}$ to $1\times10^{-1}$ Pa).

If the temperature in the processing chamber 20 (accordingly the heating temperature of the sintered magnet S) is below 700° C., the velocity of diffusion of Dy atoms of the evaporating material V adhered to the surface of the sintered magnet S into the grain boundary phase is retarded. It is thus impossible to make the Dy atoms to be diffused and homogeneously penetrated into the grain boundary phase of the sintered magnet before the thin film is formed on the surface of sintered magnet S. On the other hand, at the temperature above 1050° C., the vapor pressure increases and thus the Dy atoms in the vapor atmosphere are excessively supplied to the surface of the sintered magnet S. In addition, there is a possibility that Dy would be diffused into the grains. Should Dy be diffused into the grains, the magnetization intensity in the grains is greatly reduced and, therefore, the maximum energy product and the remanent flux density are further reduced.

In order to diffuse Dy into the grain boundary phase before the thin film made up of evaporating material V is formed on the surface of the sintered magnet S, the ratio of a total surface area of the sintered magnet S disposed on the bearing grid 21*a* in the processing chamber 20 to a total surface area of the evaporating material V in bulk form disposed on the bottom surface of the processing chamber 20 is set to fall in a range of $1\times10^{-4}$~$2\times10^{3}$. In a ratio other than the range of $1\times10^{-4}$~$2\times10^{3}$, there are cases where a thin film is formed on the surface of the sintered magnet S and thus a permanent magnet having high magnetic properties cannot be obtained. In this case, the above-described ratio shall preferably fall within a range of $1\times10^{-3}$ to $1\times10^{3}$, and the above-described ratio of $1\times10^{-2}$ to $1\times10^{2}$ is more preferable.

According to the above configuration, by lowering the vapor pressure and also by reducing the amount of evaporation of Dy the amount of supply of Dy to the sintered magnet S is restrained. In addition, by heating the sintered magnet manufactured by the two alloy method at a predetermined temperature range, the speed of diffusion of Dy and/or Tb into the grain boundary phase becomes faster. As a result of the above-described combined effects, while the Dy is prevented from getting excessively diffused into the grains in the region of near the surface of the sintered magnet, the Dy atoms adhered to the surface of the sintered magnet S can be efficiently diffused and spread into the grain boundary phase of the sintered magnet S before the adhered Dy atoms get deposited and form Dy layer (thin film) (see FIG. 1). As a result, the permanent magnet M can be prevented from deteriorating on the surface thereof, and Dy can be restrained from being excessively diffused into the grain boundary near the surface of the sintered magnet. In this manner, by having a Dy-rich phase (a phase containing Dy in the range of 5~80%) in the grain boundary phase and by diffusing Dy only in the neighborhood of the surface of the grains, the magnetization intensity and coercive force are effectively improved. In addition, there can be obtained a permanent magnet M that requires no finishing work and that is superior in productivity In this case, the permanent magnet M can effectively increase in the rare earth element-rich phase the concentration of Dy and/or Tb that is mixed in more than double and that has good diffusibility whereby the permanent magnet M has a higher coercive force.

As shown in FIG. 4, when the sintered magnet S is worked into a desired configuration by a wire cutter, and the like, after having manufactured the above-described sintered magnet S, there are cases where cracks occur in the grains which are the principal phase on the surface of the sintered magnet, resulting in a remarkable deterioration in the magnetic properties (see FIG. 4(*a*)). However, by executing the above-described vacuum vapor processing, there will be formed a Dy-rich phase on the inside of the cracks of the grains near the surface (see FIG. 4(*b*)), whereby the magnetization intensity and coercive force are recovered. On the other hand, by executing the above-described vacuum vapor processing, the grain boundary phase has the Dy-rich phase and further Dy gets diffused only near the surface of the grains. Therefore, even if a permanent magnet is obtained by cutting a sintered magnet in block shape, after having executed the above-described vacuum vapor processing, into a plurality of sliced thin pieces by means of a wire cutter and the like as a post step, the magnetic properties of the permanent magnet get hardly deteriorated. As compared with a case in which: a sintered magnet of block shape having predetermined dimensions is cut into a plurality of thin pieces; the thin pieces are then contained as they are by disposing in position inside the processing chamber; and they are then subjected to the above-described vacuum vapor processing, it is possible, for example, to perform at a shorter time the putting and taking the sintered magnet into, and out of, the box body 2. Also, the preparatory work for executing the above-described vacuum vapor processing becomes easier, and the finishing work is not required. Consequently a high productivity can be attained.

Cobalt (Co) has been added to the neodymium magnet of the prior art because a measure to prevent corrosion of the magnet is required. However, according to the present invention, since Dy-rich phase having extremely higher corrosion resistance and atmospheric corrosion resistance as compared with Nd exists on the inside of cracks of grains near the surface of the sintered magnet and in the grain boundary phase, it is possible to obtain a permanent magnet having extremely high corrosion resistance and atmospheric corrosion resistance without using Co. Furthermore, at the time of diffusing Dy adhered to the surface of the sintered magnet S, since there is no intermetallic compound containing Co in the grain boundary phase of the sintered magnet S, the metal atoms of Dy, Tb adhered to the surface of the sintered magnet S are further efficiently diffused.

Finally after having executed the above-described processing for a predetermined period of time (e.g., 1~72 hours), the operation of the heating means 3 is stopped, Ar gas of 10 KPa is introduced into the processing chamber 20 through a gas introducing means (not illustrated), evaporation of the evaporating material V is stopped, and the temperature in the processing chamber 20 is once lowered to, e.g., 500° C. Continuously the heating means 3 is actuated once again and the temperature in the processing chamber 20 is set to a range of 450° C.~650° C., and heat treatment for removing the strains in the permanent magnets is executed to further improve or recover the coercive force. Finally the processing chamber 20 is rapidly cooled substantially to room temperature and the box body 2 is taken out of the vacuum chamber 12.

In the embodiment of the present invention, a description has been made of an example in which Dy is used as the evaporating material V However, within a heating temperature range (a range of 900° C.~1000° C.) of the sintered magnet S that can accelerate the diffusion velocity Tb that is low in vapor pressure can be used. Or else, an alloy of Dy and Tb may be used. It was so arranged that an evaporating material V in bulk form and having a small specific surface area was used in order to reduce the amount of evaporation at a certain temperature. However, without being limited thereto, it may be so arranged that a pan having a recessed shape in cross section is disposed inside the box part 21 to contain in the pan the evaporating material V in granular form or bulk form, thereby reducing the specific surface area. In addition, after having placed the evaporating material V in the pan, a lid (not illustrated) having a plurality of openings may be mounted.

In the embodiment of the present invention, a description has been made of an example in which the sintered magnet S and the evaporating material V were disposed in the processing chamber 20. However, in order to enable to heat the sintered magnet S and the evaporating material V at different temperatures, an evaporating chamber (another processing chamber, not illustrated) may be provided inside the vacuum chamber 12, aside from the processing chamber 20, and another heating means may be provided for heating the evaporating chamber. After having evaporated the evaporating material V inside the evaporating chamber, the metal atoms in the vapor atmosphere may be arranged to be supplied to the sintered magnet inside the processing chamber 20 through a communicating passage which communicates the processing chamber 20 and the evaporating chamber together.

In this case, in case the evaporating material V is Dy the evaporating chamber may be heated at a range of 700° C.~1050° C. (at a temperature of 700° C.~1050° C., the saturated vapor pressure of Dy becomes about $1\times10^{-4}$ to $1\times10^{-1}$ Pa). At a temperature below 700° C., there cannot reach a vapor pressure at which the evaporating material V can be supplied to the surface of the sintered magnet S so that Dy can be diffused and homogeneously penetrated into the grain boundary phase. On the other hand, in case the evaporating material V is Tb, the evaporating chamber may be heated to a range of 900° C.~1150° C. At a temperature below 900° C., there cannot reach a vapor pressure at which the Tb atoms can be supplied to the surface of the sintered magnet S. On the other hand, at a temperature above 1150° C., Tb gets diffused into the grains and thus the maximum energy product and the remanent flux density will be lowered.

In order to remove soil, gas or moisture adsorbed on the surface of sintered magnet S before Dy and/or Tb is diffused into the grain boundary phase, it may be so arranged that the vacuum chamber 12 is reduced to a predetermined pressure (e.g., $1\times10^{-5}$ Pa) through the evacuating means 11 and that the processing chamber 20 is reduced to a pressure (e.g., $5\times10^{-4}$ Pa) higher substantially by half-digit than the pressure in the processing chamber 20, thereafter maintaining the pressures for a predetermined period of time. At that time, by actuating the heating means 3, the inside of the processing chamber 20 may be heated to, e.g., 100° C., thereafter maintaining it for a predetermined period of time.

On the other hand, the following arrangement may be made, i.e., a plasma generating apparatus (not illustrated) of a known construction for generating Ar or He plasma inside the vacuum chamber 12 is provided and, prior to the processing inside the vacuum chamber 12, there may be executed a preliminary processing of cleaning the surface of the sintered magnet S by plasma. In case the sintered magnet S and the evaporating material V are disposed in the same processing chamber 20, a known conveyor robot may be disposed in the vacuum chamber 12, and the lid part 22 may be mounted inside the vacuum chamber 12 after the cleaning has been completed.

Further in the embodiment of the present invention, a description has been made of an example in which the box body 2 was constituted by mounting the lid part 22 on an upper surface of the box part 21. However, if the processing chamber 20 is isolated from the vacuum chamber 12 and can be reduced in pressure accompanied by the pressure reduction in the vacuum chamber 12, it is not necessary to limit to the above example. For example, after having housed the sintered magnet S into the box part 21, the upper opening thereof may be covered by a foil of Mo make. On the other hand, it may be so constructed that the processing chamber 20 can be hermetically closed in the vacuum chamber 12 so as to be maintained at a predetermined pressure independent of the vacuum chamber 12.

In the embodiment of this invention, a description has been made of a case of executing vacuum vapor processing in order to achieve high productivity. This invention can also be applied to a case in which a permanent magnet of high magnetic properties can be obtained by causing Dy and/or Tb to be adhered to the surface of the sintered magnet by using a known vapor deposition apparatus or sputtering apparatus (first step), and subsequently by executing a diffusing step for diffusing the Dy and/or Tb adhered to the surface into grain boundary phase of the sintered magnet by using a heat processing furnace (second step).

Example 1

In Example 1, as the Nd—Fe—B based sintered magnet S, there was used one whose alloy composition was 29Nd-2Dy-1B-3Co-bal.Fe and that was manufactured in a so-called two alloy method. In this case, as the principal phase alloy there was manufactured one having a composition of 29Nd-1B-1.5Co-bal.Fe in the known SC fusion casting method, and the principal phase alloy was then coarsely crushed down to, e.g., less than 50 meshes in Ar to obtain coarse ground powder. As the liquid phase alloy there was manufactured one having a composition of 25Nd-38Dy-0.7B-34Co-bal.Fe in the known SC fusion casting method, and the liquid phase alloy was then coarsely crushed down to, e.g., less than 50 meshes in Ar to obtain coarse ground powder.

Then, each of the obtained coarse ground powder of the principal phase and the liquid phase was mixed in a ratio of principal phase:liquid phase=95 wt %:5 wt %. The mixture was then coarsely ground by a hydrogen grinding process and, subsequently finely ground in nitrogen atmosphere in a jet mill process, thereby obtaining mixture powder (raw meal powder). This raw meal powder was then filled into a cavity of a known uniaxial pressurizing type of compression-molding machine, thereby forming in magnetic field the raw meal powder into a predetermined shape (forming step). This formed body was disposed into a known sintering furnace and sintered by setting the processing temperature at 1050° C. for a processing time of 2 hours (sintering step), thereafter annealing processing was performed by setting the processing temperature at 530° C. for a processing time of 2 hours, thereby manufacturing the above-described sintered magnet of average grain size of 6 μm. Finally after having machining the sintered magnet to the dimensions of 40×20×5 mm, it was subjected to washing and surface finishing by barrel finishing.

Then, by using the above-described vacuum vapor processing apparatus 1, a permanent magnet M was obtained by the above-described vacuum vapor processing. In this case, it was so arranged that 60 sintered magnets S were disposed inside the box body 2 of Mo make at an equal distance to one another on the bearing grid 21*a*. In addition, as the evaporating material, Dy of bulk form (about 1 mm) of 99.9% purity was used, and a total amount of 100 g was disposed on the bottom surface of the processing chamber 20. Then, the evacuating means was actuated to once reduce the pressure in the vacuum chamber to $1\times10^{-4}$ Pa (the pressure inside the processing chamber was $5\times10^{-3}$ Pa), and also the heating temperature in the processing chamber 20 by the heating means 3 was set to 950° C. When the processing chamber 20 once reached 950° C., the above-described vacuum vapor processing was executed in this state for 2~12 hours, and then heat treatment to remove the strains in the permanent magnet was performed. In this case, the heat treatment temperature was set to 400° C., and the processing time was set to 90 minutes.

Comparative Example 1

In Comparative Example 1, as the Nd—Fe—B based sintered magnet, there was used one whose alloy composition was 29Nd-2Dy-1B-3Co-bal.Fe and that was manufactured in a so-called one alloy method. The sintered magnet was formed into a parallelepiped shape of 40×20×5 mm. In this case, an alloy raw material was manufactured by formulating Fe, Nd, Dy B and Co in the above-described composition ratio, in a known SC fusion casting method. The alloy raw material was then coarsely crushed down to, e.g., less than 50 meshes in Ar to obtain coarse ground powder. The obtained coarsely ground powder was once coarsely ground in hydrogen grinding step and was subsequently finely ground by jet mill fine grinding step in nitrogen atmosphere to thereby obtain alloy raw material (raw meal) powder. Then, this raw meal powder was filled into a cavity of a known uniaxial pressurizing type of compression-molding machine, thereby forming in magnetic field the raw meal powder into a predetermined shape (forming step). This formed body was disposed into a known sintering furnace and was sintered by setting the processing temperature at 1050° C. for a processing time of 2 hours (sintering step), thereafter aging process was performed by setting the processing temperature at 530°

C. for a processing time of 2 hours, thereby manufacturing the above-described sintered magnet of average grain size of 6 μm. Finally after having machined the sintered magnet to the dimensions of 40×20×5 mm, the sintered magnet was subjected to washing and surface finishing by barrel finishing.

Subsequently by using the above-described vacuum vapor processing apparatus 1, a permanent magnet M was obtained in the above-described vacuum vapor processing. In this case, vacuum vapor processing was executed on the same conditions as those in Example 1.

FIG. 5 is a table showing average values of magnetic properties (measured by using B-H curve tracer) at the time of having obtained a permanent magnet under the above-described conditions, together with average values of the magnetic properties before vacuum vapor processing. According to this table, in Comparative Example 1, by performing the vacuum vapor processing, the coercive force was improved, and the longer becomes the processing time, the higher becomes the coercive force. When the vacuum vapor processing was performed for the period of time of 12 hours, the coercive force was 23.1 kOe. On the other hand, in Example 1, a high coercive force of 25.3 kOe was obtained for half the time (6 hours) of that in Comparative Example 1. It can thus be seen that the time for vacuum vapor processing (i.e., the time for diffusion) can be shortened and the productivity can be improved.

Example 2

In Example 2, by using the Nd—Fe—B based sintered magnet S that was manufactured in the similar manner as in Example 1, vacuum vapor processing was executed in the similar manner as in Example 1 to thereby obtain a permanent magnet M. In this case, it was so arranged that 60 sintered magnets S were disposed inside the box body 2 of Mo make at an equal distance to one another on the bearing grid 21*a*. In addition, as the evaporating material, Tb of bulk form (about 1 mm) of 99.9% purity was used, and a total amount of 1000 g was disposed on the bottom surface of the processing chamber 20. Then, the evacuating means was actuated to once reduce the pressure in the vacuum chamber to $1\times10^{-4}$ Pa (the pressure inside the processing chamber was $5\times10^{-3}$ Pa), and also the heating temperature in the processing chamber 20 by the heating means 3 was set to 1000° C. When the processing chamber 20 reached 1000° C., the above-described vacuum vapor processing was executed in this state for 2~8 hours, and then heat treatment to remove the strains in the permanent magnet was executed. In this case, the heat treatment temperature was set to 400° C., and the processing time was set to 90 minutes.

Comparative Example 2

In Comparative Example 2, a Nd—Fe—B based sintered magnet that was manufactured in the similar manner as in Comparative Example 1 was used. By using the above-described vacuum vapor processing apparatus 1, a permanent magnet M was obtained in the above-described vacuum vapor processing. In this case, vacuum vapor processing was executed on the same conditions as those in Example 2.

FIG. 6 is a table showing average values of magnetic properties (measured by using a B-H curve tracer) at the time of having obtained a permanent magnet under the above-described conditions, together with average values of the magnetic properties before vacuum vapor processing. According to this table, in Comparative Example 2, by executing the vacuum vapor processing, the coercive force is improved, and the longer becomes the processing time, the higher becomes the coercive force. When the vacuum vapor processing was performed for the period of time of 8 hours, the coercive force was 25.8 kOe. On the other hand, in Example 2, a high coercive force of 25.6 kOe was obtained for one-forth the period of time of Comparative Example 2. It can thus be seen that the time for vacuum vapor processing (i.e., the time for diffusion) can be shortened and the productivity can be improved. In addition, it can be seen that, when the processing time exceeds 4 hours, there can be obtained a permanent magnet M of high magnetic properties having a coercive force exceeding 28 kOe.

BRIEF DESCRIPTION OF THE DRAWINGS

FIG. 5 is a table showing magnetic properties of the permanent magnet manufactured in accordance with Example 1; and FIG. 6 is a table showing magnetic properties of the permanent magnet manufactured in accordance with Example 2.

DESCRIPTION OF REFERENCE NUMERALS AND CHARACTERS

Figure 1:
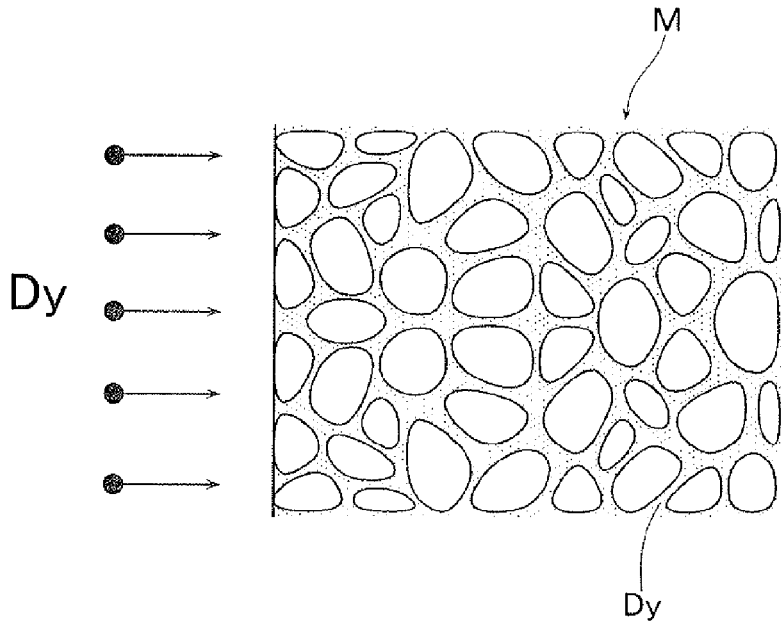
FIG. 1 is a schematic explanatory view of a cross-section of the permanent magnet manufactured in accordance with this invention.
Figure 2:
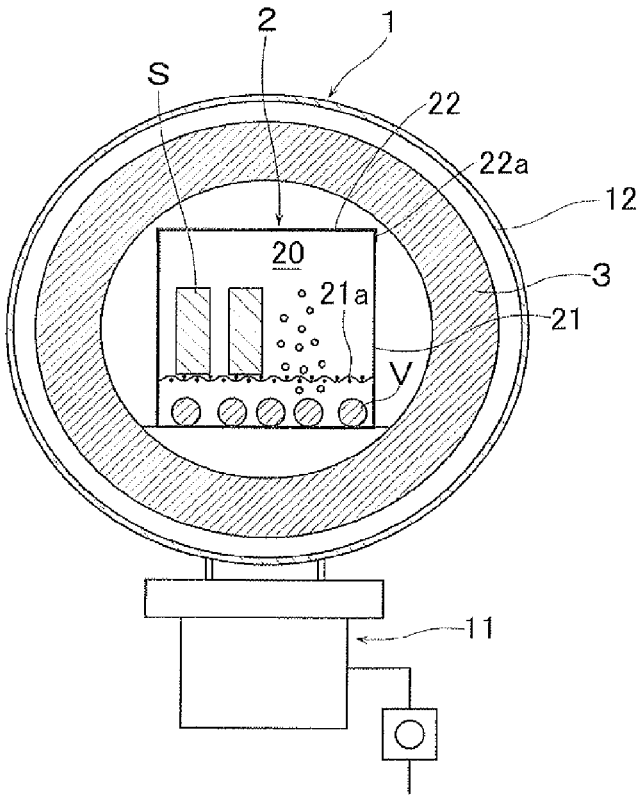
FIG. 2 is a schematic view of the vacuum processing apparatus for executing the processing of this invention.
Figure 3:
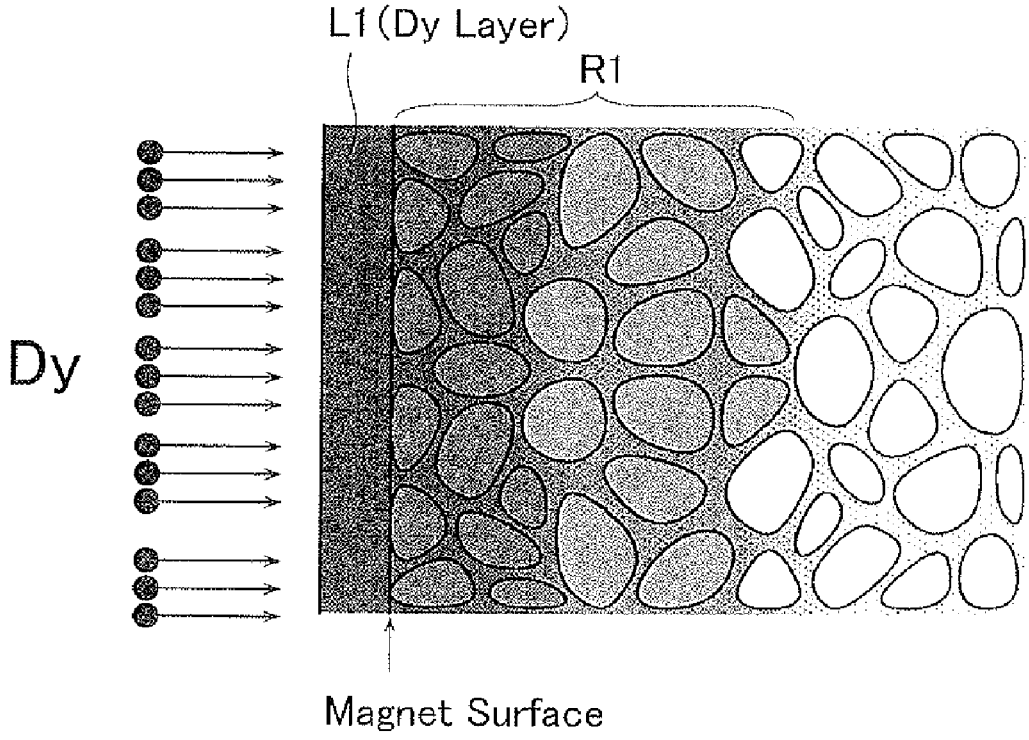
FIG. 3 is a schematic explanatory view of a cross-section of a permanent magnet manufactured in accordance with a prior art.
Figure 4A:
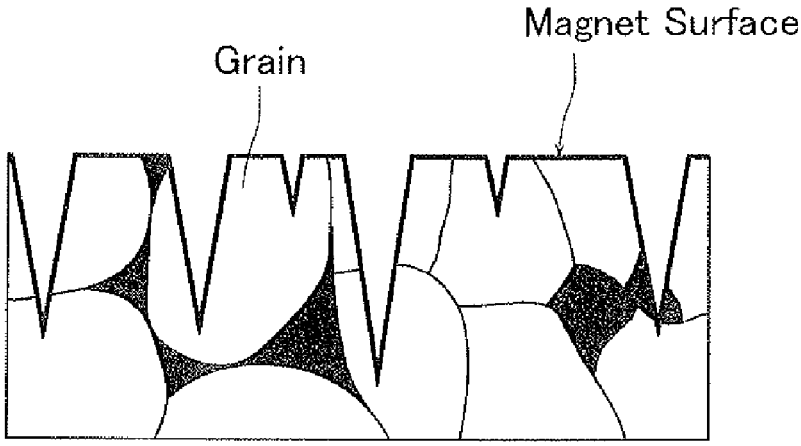
FIG. 4(*a*) is an explanatory view showing deterioration of the surface of the sintered magnet caused by machining, and FIG. 4(*b*) is an explanatory view showing the surface condition of a permanent magnet manufactured in accordance with this invention.
Figure 4B:
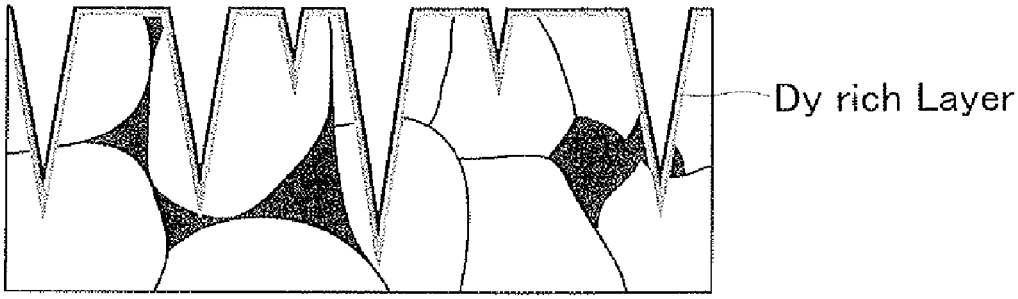

1 vacuum vapor processing apparatus
12 vacuum chamber
20 processing chamber
2 box body
21 box part
22 lid part
3 heating means
S sintered magnet
M permanent magnet
V evaporating material

What is claimed is:

1. A method of manufacturing a permanent magnet comprising: manufacturing an iron-boron-rare-earth based sintered magnet by:

mixing a first powder and a second powder in a predetermined mixing ratio into a mixed powder, the first powder comprising a principal phase alloy including an $R_2T_{14}B$ phase, where R is at least one rare earth element including Nd and where T is a transition metal including Fe, and the second powder comprising a liquid phase alloy including a higher content of R than the $R_2T_{14}B$ phase of the first powder and a R-rich phase;

press-forming the mixed powder oriented in a magnetic field into a press-formed body; and sintering the press-formed body in one of vacuum and inert gas atmosphere providing the manufactured sintered magnet and an evaporating material disposed at a distance from each other;

providing, through a vapor atmosphere, the evaporating material comprising at least one of Dy and Tb to at least part of a surface of the sintered magnet; and diffusing, through heat-treatment at a first predetermined temperature, the at least one of Dy and Tb adhered to at least part of the surface of the sintered magnet into a grain boundary phase of the sintered magnet, before a thin film made of the evaporating material is formed on the at least part of the surface of the sintered magnet.

2. The method of manufacturing the permanent magnet according to claim 1, before performing the providing the evaporating material and the diffusing, further comprising:

disposing the sintered magnet in a processing chamber;

disposing the evaporating material comprising the at least one of Dy and Tb in the processing chamber or another processing chamber;

heating the processing chamber or the another processing chamber such that the evaporating material evaporates and generates the vapor atmosphere, wherein the evaporated evaporating material through the vapor atmosphere adheres to the at least part of the surface of the sintered magnet;

adjusting an amount of supply of the evaporated evaporating material to the at least part of the surface of the sintered magnet, wherein metal atoms of the at least one of Dy and Tb of the adhered evaporating material are diffused into the grain boundary phase of the sintered magnet before a thin film made of the evaporating material is formed on the at least part of the surface of the sintered magnet.

3. The method of manufacturing a permanent magnet according to claim 2, wherein the sintered magnet and the evaporating material are disposed at the distance from each other before performing the adhering and the diffusing.

4. The method of manufacturing a permanent magnet according to claim 2, wherein a specific surface area of the evaporating material to be disposed in the processing chamber or the another processing chamber is varied to increase or decrease an amount of evaporation at a constant temperature, thereby adjusting the amount of supply of the evaporated evaporating material.

5. The method of manufacturing a permanent magnet according to claim 2, wherein, prior to the heating of the processing chamber or the another processing chamber that has disposed therein the sintered magnet, the processing chamber or the another processing chamber is reduced in pressure to a predetermined pressure and is kept to that pressure.

6. The method of manufacturing a permanent magnet according to claim 5, wherein, after having reduced the pressure in the processing chamber or the another processing chamber, the processing chamber or the another processing chamber is heated to a predetermined temperature and is kept at the first predetermined temperature.

7. The method of manufacturing a permanent magnet according to claim 2, wherein, prior to the heating of the processing chamber or the another processing chamber that has disposed therein the sintered magnet, cleaning by plasma is performed of the surface of the sintered magnet.

8. The method of manufacturing a permanent magnet according to claim 2, wherein, after the at least one of Dy and Tb has been diffused into the grain boundary phase of the sintered magnet, heat treatment is executed for removing strains of the permanent magnet at a second predetermined temperature that is lower than the first predetermined temperature.

9. The method of manufacturing a permanent magnet according to claim 2, wherein, after having diffused the metal atoms into the grain boundary phase of the sintered magnet, the permanent magnet is cut into a predetermined thickness in a direction perpendicular to a direction of magnetic orientation.

10. The method of manufacturing a permanent magnet according to claim 3, wherein a specific surface area of the evaporating material to be disposed in the processing chamber or the another processing chamber is varied to increase or decrease an amount of evaporation at a constant temperature, thereby adjusting the amount of supply of the evaporated evaporating material.

* * * * *